United States Patent [19]

Fleischmann et al.

[11] 3,959,929

[45] June 1, 1976

[54] DEVICE FOR PRECISION GRINDING AND POLISHING OF WORKPIECES

[75] Inventors: Johann R. Fleischmann; Willy Fechter; Heinrich Schmidt, all of Nurnberg, Germany

[73] Assignee: Doll & Co., Nurnberg, Germany

[22] Filed: Apr. 18, 1974

[21] Appl. No.: 462,122

[30] Foreign Application Priority Data

Apr. 21, 1973 Germany ..... 2320349

[52] U.S. Cl. ..... 51/68; 219/69 R

[51] Int. Cl.[2] ..... B24B 7/02

[58] Field of Search ..... 219/69 R, 69 G, 69 V, 219/69 E, 69 D, 69 M, 68, 76; 51/58, 59, 237, 55, 68; 74/568 R

[56] References Cited

UNITED STATES PATENTS

| | | | |
|---|---|---|---|
| 2,659,185 | 11/1953 | Indge | 51/55 |
| 2,794,110 | 5/1957 | Griffith | 219/69 V |
| 2,838,652 | 6/1958 | Poateofield | 219/69 V |
| 2,974,215 | 3/1961 | Inoue | 219/69 V |
| 3,161,992 | 12/1964 | Gentry et al. | 51/59 R |
| 3,714,893 | 2/1973 | Cole | 74/568 |
| 3,717,567 | 2/1973 | Badine | 219/69 V |
| 3,806,691 | 4/1974 | Roach | 219/69 G |
| 3,849,623 | 11/1974 | Gilliatt | 219/10.55 R |

*Primary Examiner*—Bruce A. Reynolds
*Attorney, Agent, or Firm*—Frank J. Jordan

[57] ABSTRACT

A device for precision grinding and polishing the surfaces of a workpiece such as the surfaces of molds or the like includes a base means on which the workpiece is movable in one plane. A stand supported on the base plate is provided with a carrying arm on which there is mounted an oscillating device operable to oscillate a tool. The carrying arm is arranged such that it may be adjustable in all three spacial coordinates. The oscillating tool serves as the carrier for the grinding medium for grinding and polishing a workpiece disposed on the base means.

11 Claims, 9 Drawing Figures

IV

DEVICE FOR PRECISION GRINDING AND POLISHING OF WORKPIECES

BACKGROUND OF THE INVENTION

This invention relates to a device for the precision grinding and polishing of surfaces of a workpiece which surfaces are situated in the plane of a reciprocating tool which serves as the carrier of the grinding or polishing medium. The invention is particularly useful for the processing of steel shapes or molds.

The removal of roughness or unevenness on workpieces caused by procedures such as turning, milling, or eroding, particularly on steel shapes or molds causes formidable difficulties and demands comparatively large amounts of manual labor. Usually the workpiece is clamped firmly for that purpose and is processed by the aid of a to and fro oscillating tool supplied with a grinding medium and guided by hand. It is important that the roughness of the workpieces are reduced to the extent that complete mold release results when the molds are used in connection with injection molding or diecasting.

An object of the present invention is to remove these defects which are of great importance in the preparation of molds and to create a device for precision grinding and polishing as described above, thereby producing a considerably improved result and a considerable saving of time.

The present invention solves this problem by the provision of a device which consists of a base to accept a workpiece movable in one plane and also consists of a stand rigidly connected to the base. The stand is provided with a carrying arm which is adjustable in the direction of all three space coordinates and which is furnished at its free end with an oscillating drive. The oscillating drive is connected to a polishing or grinding tool which serves as the carrier for the polishing or grinding medium.

The arrangement of the present invention differs from the heretofore well known arrangements insofar as the workpiece is no longer firmly clamped down but rather is arranged in such a way that it may be moved in one plane. On the other hand, the oscillating drive with the polishing and grinding tool is fastened to the stand and connected to a clamping arrangement in such a way that maximum adjustability of the stand makes it possible to clamp the workpiece in every possible position so that the workpiece may be practically acceptably treated on all surfaces of interest.

It has been found that it is remarkably easier and simpler to make the workpiece movable and to move it towards or to press it against the tool. A surprising advantage of the arrangement according to the present invention is that it obviates the heretofore needed frequent change of grain size of the grinding medium or grinding paste. It is now possible to use one paste of rather small grain size during the entire working period.

Finally it is particularly important that the device according to the present invention makes it possible to use on the device of the present invention the electrodes previously used for spark erosion on another machine as carriers of the grinding or polishing medium, thus as grinding or polishing tools, because the consecutive grinding or polishing does not offer any difficulties whatsoever. The economy or amount of time saved is more than 50 percent, for example, when a device according to the invention is used to precision grind a workpiece which was previously produced by spark erosion and then followed consecutively by the precision grinding on the device of the present invention. At the same time a considerable improvement of surface quality is obtained. The surface shows, when the device of the present invention is used, a uniformity and exactness impossible to obtain by manual work.

A further embodiment of the invention encompasses an accepting mechanism for the workpiece which consists of a carrying plate upon which the workpiece rests. The carrying plate is disposed upon a baseplate which is solidly connected to a stand and which carrying plate is movable in the direction of both coordinates in the plane of the baseplate. The mobility of the carrier plate which accepts the workpiece is sufficiently large to lead the workpiece, which is solidly fastened to the carrier plate, towards the tool by manually moving the carrier plate. Preferably the carrier plate may be mounted on an axial ball bearing which is arranged on its bottomside and which is movable in its own plane. Preferably a cage containing a multiplicity of ball bearings is provided between the baseplace and the carrier plate.

In another alternative arrangement of an accepting mechanism for the workpiece, there may be provided a turntable which is arranged upon the baseplate which is connected to the stand and which is rotatable around an axis vertically disposed relative to the baseplate. In every case it is important to keep the workpiece mobile and, on the other hand, to lock the workpiece in position towards the tool by aid of the stand while the tool is kept oscillating by the oscillating drive.

The invention encompasses a stand perpendicular to the baseplate and provided with a stand bushing which can be adjusted as to height, which can be rotated, and which is lockable. On the stand bushing there is provided a support arm having a longitudinal axis extending transversely to the axis of the stand and arranged in such a way that it may be moved along its longitudinal length. Thus freedom of movement is provided in two directions, that is, a swivel movement in a horizontal plane and an adjustability as to height in a vertical plane between the stand and its bushing. The stand has one more freedom of movement by the capability of the support arm to be moved along its length.

It is particularly advantageous to arrange between the stand and the stand bushing a self-restraining rack and pinion drive so that the stand bushing may be adjusted as to its height upon the stand. According to another feature, the rack and pinion may consist of a rack which may be swingably guided in a longitudinal groove upon the surface of the stand bushing parallel to its axis. The rack meshes with a pinion gear attached to the stand bushing and the gear is connected to a handwheel. Practically, the stand bushing is capable of swinging 360° so that the tool may be used also on workpieces extending beyond the supporting device, for example on exceedingly large workpieces.

In another feature of the present invention the carrier arm is disposed in a carrier bushing which is connected to the stand bushing, and this carrier bushing may, as the present invention furthermore provides, be pivotable around its own axis and also pivotable around an axis which is perpendicular to the axis of the stand bushing. This inclination of the tool obtained by the aforementioned pivotal mounting makes it possible to machine undercuts or also planes which are inclined to the direction of removing from a mold.

According to another feature of the present invention the carrier arm may not be turned around in the carrier bushing and may have at its free end a header carrying the oscillating drive. The header is pivotable around the longitudinal axis of the carrier arm and around another axis which is perpendicular to the longitudinal axis and which lies in the oscillating plane of the carrier bushing. This mounting arrangement makes the tool still more mobile, a fact which will facilitate the approach of the workpiece to the tool.

It is particularly advantageous to arrange between the header and the carrier arm a bearing block arrangement having a bearing plate for the oscillatable holding of the header and a bearing yoke between whose legs there is provided a mating oscillating plate which is fastened to the end of the carrier arm. A transversely disposed set screw extends through the legs of the bearing yoke and the oscillating plate which set screw also serves as the oscillating axis. Considering that under practical conditions the angle of inclination of a plane as regards the direction of the removal from a mold cannot have any arbitrary size, the pivoting of the header towards the bearing block arrangement, that is the pivoting around the longitudinal axis of the carrier arm, may be limited, for example to 15° towards both sides from the vertical.

The invention is furthermore characterized by fastening the driving motor of the oscillating drive to a support on the header and by arranging upon the axle of the drive motor an eccentric cam. A push rod mates with the eccentric cam and carries the tool at its lower end. Preferably the push rod is provided with a gripping device to hold the tool. The tool may lie along the longitudinal axis of the push rod and thus also in the direction of the oscillation of the moving tool. It may also be arranged at an angle, preferably a right angle to the oscillation, for example in order to treat a surface of the workpiece which is vertical to the carrier plate of the mounting installation for the workpiece.

The aforementioned eccentric cam has a regulatable lift and consists of two bushings which are under axial spring pressure and which mesh excentrically so that they may be arrested in varying angles against each other. The exterior of the bushings carry a connecting rod which is connected to the push rod. The lift of the eccentric cam may be regulated for example in the range of 0 to 2 mm in small steps or steplessly in order to adapt the motion of the tool to the varying surfaces which have to be worked on.

According to the present invention the device may be furnished with graduated angle scales to show the pivoting angles between the stand and the stand bushing, between the carrier arm and the bearing block, and finally between the bearing block arrangement and the header. This construction renders possible an exact positioning of the workpiece in space in which case frequently the setting of each scale is an exact function of all the other scales.

The stand bushing and the carrier bushing each are provided with a longitudinal slot through which a set-screw poses transversely and which is tightened after each setting.

Other features which are considered as characteristic for the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

SUMMARY OF THE INVENTION

A device for precision grinding and polishing the surfaces of a workpiece includes a base means on which the workpiece is movable in one plane. A stand is mounted on the base means and this stand in turn supports a carrying arm on which a tool driving oscillating device is carried. The carrying arm is mounted and arranged such that it may be adjustable in all three spacial coordinates. The tool driven by the oscillating device carries the grinding or polishing medium for grinding or polishing the workpiece which is disposed on the base means.

DESCRIPTION OF THE PREFERRED EMBODIMENTS

Figures 1, 2:
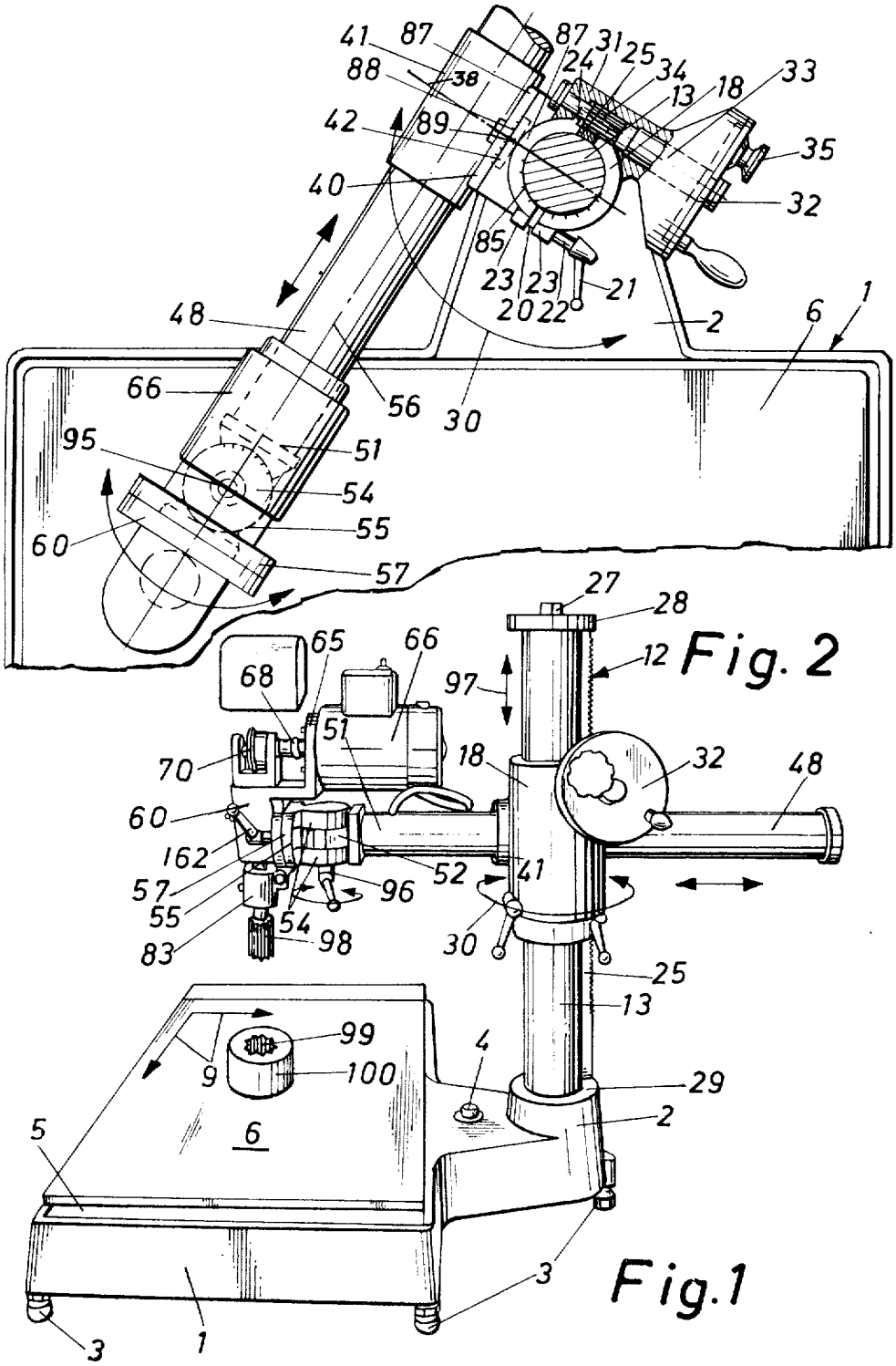
FIG. 1 is a perspective view of the precision grinding and polishing device according to one embodiment of the present invention.
FIG. 2 is a plan view of the device partially cut away and in section.

Referring to the drawings there is shown a base plate 1 having a lateral support 2. The base plate 1 sits upon adjustable legs 3 which aid to adjust the horizontal position of the base plate 1. A level 4 is arranged upon the support 2 and indicates the need for such an adjustment. A flat carrying plate 6 is disposed upon a bearing block in a trough 5 of the base plate 1 which is usually prepared from a single casting. The carrying plate 6 is situated upon the bearing block which consists of a plate shaped cage 7 whose respective recesses carry a multiplicity of ball bearings 8. Thus the carrying plate 6 is supported on the base plate 1 by the ball bearings 8. The carrying plate 6 has in both coordinates 9 of its plane a mobility having a clearance 10 with the walls 11 of the base plate 1. The workpiece lies upon the carrying plate 6, and the mobility of the carrying plate 6 allows the workpiece to be moved in the plane of the carrying plate 6 by hand.

Figures 3, 4, 5:
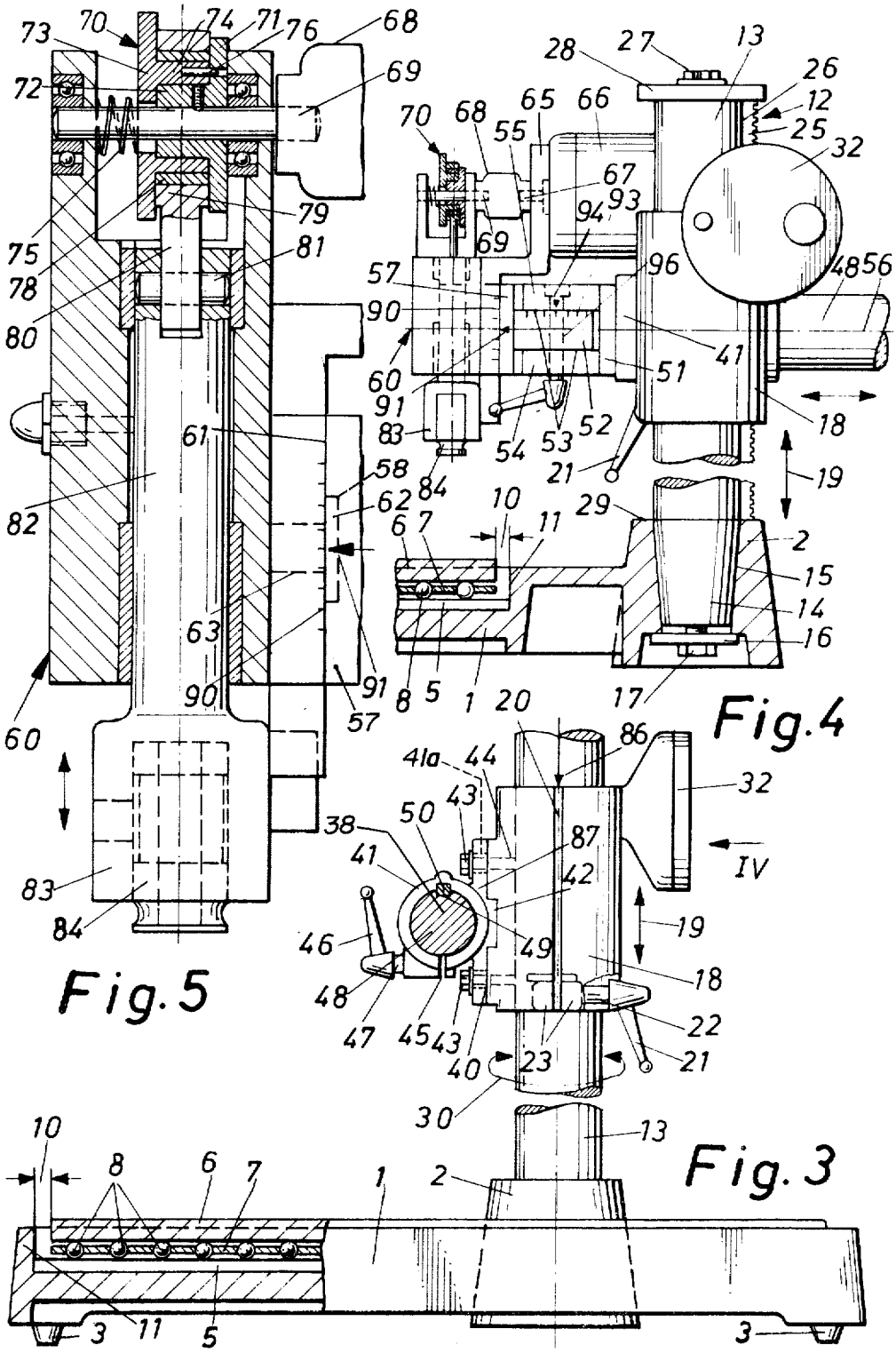
FIG. 3 is an elevational view of the device partially cut away and in section.
FIG. 4 is another elevational view looking in the direction of the arrow IV in FIG. 3 and also partly broken away and in section.
FIG. 5 is an elevational and sectional view, on a larger scale, of the oscillating drive mechanism mounted on the end of the carrier arm.
Figure 6:
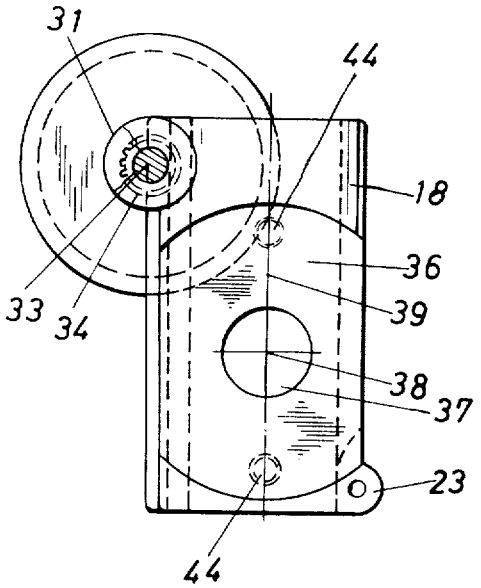
FIG. 6 is a partial elevational and detail view of the stand bushing.
Figure 7:
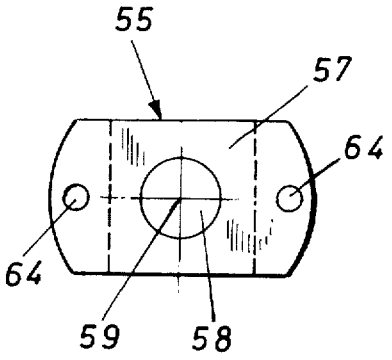
FIG. 7 is a front detail view of the bearing block arrangement.

Rigidly connected to the base plate 1 is a stand 12 which serves as a holder for the tool, such holder being adjustable in its position towards the base plate 1. A post 13 for the stand 12 consists of a cylindrical column having a conically shaped foot 14 which fits into a respective conical recess 15 in the support 2 and is solidly braced with a bracing plate 16 by aid of a bracing screw 17. A stand bushing 18 is disposed upon the post 13 and is movable in the direction of the double arrow 19 (FIG. 3) either up or down. The post bushing 18 is provided with a transverse longitudinal slot 20 which is traversed by a set screw 22 having a crank 21. The set screw 22 is threadedly led through two shoulders 23 on both sides of the longitudinal slot 20. The eventually desired position of the post bushing 18 upon the post 13 can be attained by locking in position by tightening the set screw 22. A rack 25 is positioned within an axially parallel longitudinal groove 24 in the post bushing 18 in such a way that the rack 25 lies with its interior side 26 disposed on the circumference of the post 13. The length of the rack 25 corresponds to the distance between a head plate 28 which is fastened to the post 13 with a screw 27 and a surface 29 on the support 2. The interior side 26 of the rack 25 moves upon the circumference of the post 13 when the stand bushing 18 is pivoted around the post 13 after the set screw 22 has been loosened. This is suggested by the double arrow 30 in FIG. 2. Preferably an angle of 360° is used when pivoting the stand bushing 18 about the post 13.

A shaft 33 provided with a handwheel 32 is placed in an attachment 31 projecting from the stand bushing 18. A pinion gear 34 is fastened to the axle 33 and meshes with the rack 33. This rack and pinion engagement consisting of rack 25 and pinion gear 34 serves to regulate the height of the stand bushing 18 on the post 13. In this regard the rack 25 slides in its groove 24 in the stand bushing 18. This regulation in height also is performed when the set screw 22 is loosened. The rack and pinion arrangement is self-locking so that each desired height of the stand bushing 18 upon post 13 may be attained locked in position even if set screw 22 is not yet tightened.

Upon the stand bushing 18 there is provided a surface 36 parallel to the axis of the stand bushing 18. The latter has a depression 37 the cross section of which is circular. The axis 38 of the circular depression 37 is perpendicular to the longitudinal axis 39 of the stand bushing 18. The surface 36 serves as a base for a similar bearing surface 40 on a carrying bushing 41, the latter being provided with a cylindrical guiding connection 42 having a cross section corresponding to the cross section of the depression 37 so that the carrying bushing 41 is capable of being rotated about axis 38 relative to the stand bushing 18. The bushing has slots **41*a* and is fastened with screws 43 which engage in respective drill holes 44 in the stand bushing 18. The carrying bushing 41 may be rotated around axis 38 relative to the stand bushing 18 once the screws 43 have been loosened. The carrying bushing 41 is also provided with a longitudinal slot 45 which again is traversed by a set screw 47 provided with a crank 46.**

The carrying bushing 41 serves to accept a carrying arm 48 which consists of a cylindrical arm and which is secured against rotation in the carrying bushing 41 by a key 50 which projects into a groove 49. A swivel carriage 52 is fastened to the free end 51 of the carrying arm 48. The swivel carriage 52 has free plane surfaces 53 which contact the corresponding plane surfaces of a bearing yoke 54 of a bearing block 55. The bearing block 55 is provided with a flat bearing plate 57 which is perpendicular to the axis 56 of the carrying arm 48, such bearing plate 57 corresponding to the base plate surface 36 upon the stand bushing 18. The bearing plate 57 also contains a cylindrical depression 58 having an axis 59 which coincides with the axis 56 of the carrying arm 48. The bearing block 55 carries a header 60 which is provided for that purpose with a corresponding bearing surface 61 bearing a cylindrical projection 62, the dimensions of which correspond with the dimensions of the depression 58 in the bearing plate 57 so that the header 60 is centered by the mating of the projection 62 and the depression 58 in the bearing plate 57.

The header 60 which carries all of the swiveling drive for the tool is fastened with two set screws which are introduced through holes 63 drilled into the header 60 and through the holes 64 of the bearing plate 57 in the bearing block 55. The header 60 may be moved by a limited angle of 15° from its normally vertical position towards the left or right when the set screws have been loosened.

Figure 8:
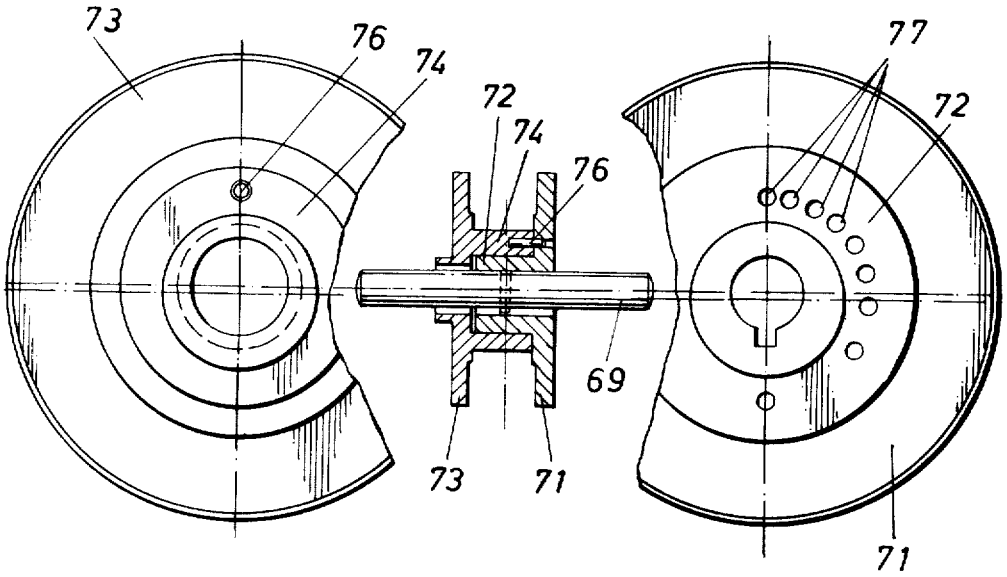
FIG. 8 is an exploded view partially broken away and partially in section of the eccentric cam means.

The header 60 has an offset arm 65 having a flange to which a drive motor 66 is affixed. The drive motor 66 has a drive shaft 67 which is connected by an elastic clutch 68 to an axle 69 upon which an adjustable eccentric cam means 70 is provided. The cam means 70 consists of an inner bushing 72 which sits upon a disk 71, as shown on the right in FIG. 5, and an eccentric external bushing 74 which is connected to a left disk 73. Both are engaged with each other by the pressure of a spring 75 and arrested against each other by a pin 76 which is rooted or mounted in the exterior bushing 74 and which is capable of engaging the corresponding notches 77 (FIG. 8) in the disk 71. A piston rod 80 having a ring shaped head 79 is placed upon or about the external bushing 74 by the intermediary of a bearing 78. The piston rod 80 is connected by a pin 81 with a push rod 82 having a lower end 83 on which a gripper or tool holder 84 is situated serving as a holder for a tool 98.

An angle protractor or measuring scale 85 (FIG. 2) is arranged upon the upper plane face of the stand bushing 18, such scale 85 cooperating with a mark 86 on the post 13 to thereby make it possible to take a reading of the angular position of the stand bushing 18. Correspondingly, an angle protractor or measuring scale 88 is provided upon the bearing plate 87 of the carrying bushing 41 and a cooperating mark 89 is disposed on the stand bushing 18. An additional angle protractor or measuring scale 90 is located on the header 60 and this cooperates with a corresponding mark 91 on the bearing plate 57 of the bearing block 55. Finally, another angle protractor of measuring scale 93 is provided on the swivel carriage 52 and this cooperates with a corresponding mark 94 on the bearing yoke 54 of the bearing block 55.

The self-locking of the rack and pinion drive may be effected simply as follows. Thrust pieces sitting in the stand bushing 18 act laterally under the pressure of a spring upon the rack 25 so that a frictional force reacts against a change of height of the stand bushing 18 upon the post 13 in the direction of the double arrow 97, such frictional force being sufficient to prevent any unwanted descent of the stand bushing 18 with the carrying arm 48.

According to FIG. 1 a burn electrode 98, which was previously used on another machine, is fastened by the gripper of holder 83 and is capable of now serving as a tool for polishing the recess 99 in a workpiece 100 located on the carrying plate 6. Thus, the same tool 98 which now carries the grinding paste in the present device was previously used in a preceding operation, that is in a preceding operation involving the preparation of the recess 99 in the workpiece 100 by spark erosion as a burn electrode. The workpiece 100 shows, for example an internal gear arrangement, whereas the electrode 98 shows on the other hand the corresponding external gear arrangement.

Figure 9:
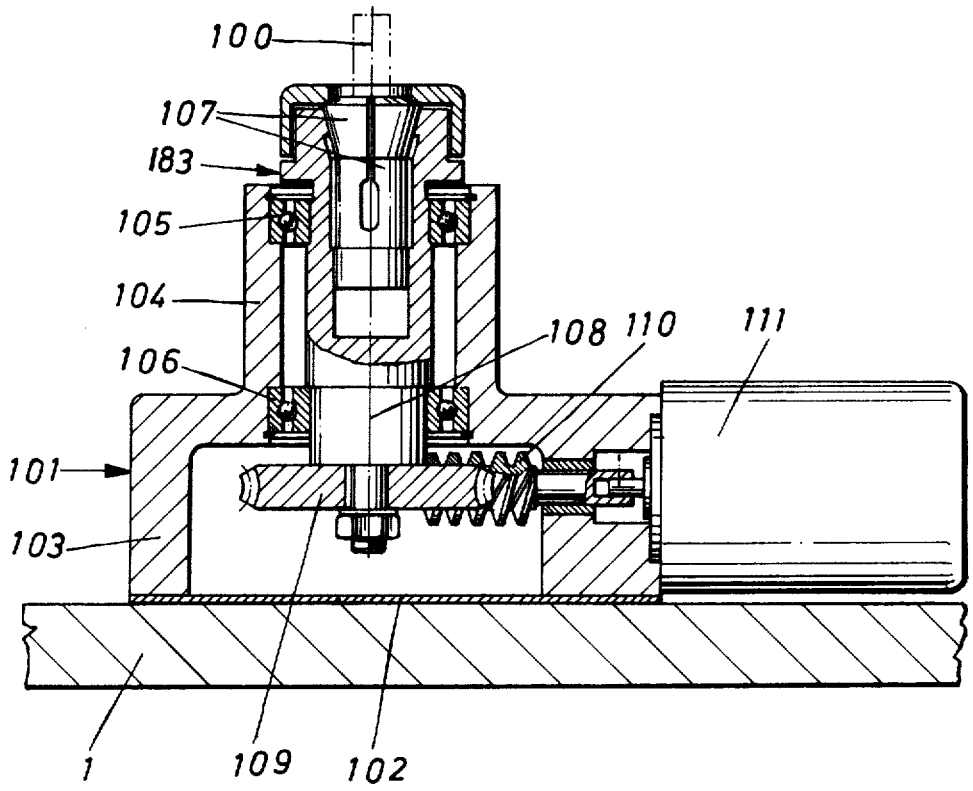
FIG. 9 is an elevational and sectional view of an alternate arrangement for supporting the workpiece on the base.

FIG. 9 shows an alternate embodiment wherein the mounting for the workpiece 100, which in this case is a cylindrical core, consists of a turntable 101 which is fastened to the base plate 1 which is only partially shown. A housing 103 has a base plate 102 and carries in an extension 104 a collett or gripper 183 having jaws 107 which hold the workpiece 100 in place. The collett or gripper 83 is rotatable in roller bearings 105 and 106. The lower end 108 of the collett or gripper 83 is connected to a worm gear 109 which meshes with the worm 110 of a drive means 111. In use the turntable 101 is arranged in such a way upon the base plate 1 that the workpiece touches the non-illustrated tool which serves as the carrier of the grinding or polishing media. The drive puts the workpiece 100 into a rotating motion until the grinding or polishing process is concluded.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. A device for precision grinding and polishing the surfaces of a workpiece comprising a base means, a carrier for carrying said workpiece, operable means movably mounting said carrier on said base means such that said carrier and the workpiece carried thereon may be moved to desired positions relative to said base means, a post perpendicular to the general plane of said base means, a stand bushing adjustably mounted on said post for movement in a vertical and rotational direction relative to said post, a rack and pinion operably disposed between said post and said stand bushing, said rack being movably mounted about the circumference of said post, said stand bushing having a longitudinal groove in which said rack is slidable, said pinion being rotatably mounted on said stand bushing and meshing with said rack to provide for raising and lowering said stand bushing on said post, said stand bushing having means for adjustably supporting said carrying arm for longitudinal and angular movement, a carrying arm, means mounting said carrying arm on said stand bushing, a reciprocating device operable to reciprocate a tool, means mounting said reciprocating device on said carrying arm, said means for mounting said carrying arm being operable to provide for adjustability of said carrying arm in all three spacial coordinates, said tool being the carrier of a grinding or polishing medium for grinding or polishing said workpiece on said base means, said movable mounting of said carrier on said base means permitting said workpiece to be moved in the grinding and polishing process to thereby automatically align the workpiece with said tool.

2. A device according to claim 1 wherein said base means comprises a base plate said operable means comprising bearing means mounting said carrier on said base plate for movement in two coordinate directions in the plane of the base plate, said post being connected to said base plate.

3. A device according to claim 2 wherein said bearing means comprises ball bearings movably mounting said carrier plate on said base plate.

4. A device according to claim 1, wherein said base means comprises a base plate, said carrier comprising a turntable positioned on said base plate, said turntable being rotatable about an axis perpendicular to the general plane of the base plate, said post being connected to said base plate.

5. A device according to claim 1 wherein said means for adjustably supporting said carrying arm comprises a carrying bushing rotatably mounted on said stand bushing.

6. A device according to claim 5 wherein said carrying bushing is rotatable about an axis perpendicular to the longitudinal axis of said carrying bushing and also perpendicular to the longitudinal axis of said post.

7. A device according to claim 5 wherein said carrying arm is secured to said carrying bushing, said reciprocating device comprising a header pivotally mounted on said carrying arm for pivotal movement about the longitudinal axis of said carrying arm and for pivotal movement about an axis perpendicular to the longitudinal axis of said carrying arm, said axis perpendicular to the longitudinal axis of said carrying arm lying in the pivoting plane of said carrying bushing.

8. A device according to claim 7 including a bearing block disposed between said header and said carrying arm, said bearing block having a bearing plate on which the header is rotated relative to the longitudinal axis of said carrying arm, a swivel carriage secured to the end of said carrying arm, said bearing plate mounting a bearing yoke which straddles said swivel carriage, and a screw means perpendicularly traversing said yoke and swivel carriage, said screw means defining said axis which is perpendicular to the longitudinal axis of said carrying arm and about which said header is pivotal.

9. A device according to claim 7 wherein said header has an offset arm, a drive motor mounted on said offset arm, an eccentric cam means driven by said drive motor, and a push rod means driven by said eccentric cam means, said push rod means carrying said tool at its lower end.

10. A device according to claim 9 wherein said push rod means is provided with tool holder means to hold said tool.

11. A device according to claim 9 wherein said eccentric cam means comprises a pair of bushings eccentrically engaged with one another, biasing means biasing said two bushings into said engagement, and means for adjusting the relative angular positions of said two bushings to thereby adjust the eccentric lift of said eccentric cam means, said push rod means comprising a piston rod connected to a push rod.

* * * * *